US007104934B1

(12) United States Patent
Smith

(10) Patent No.: US 7,104,934 B1
(45) Date of Patent: Sep. 12, 2006

(54) HAND EXERCISE DEVICE

(76) Inventor: John Patrick Smith, 1419 Hindman Ave., Mt. Pleasant, SC (US) 29464

( * ) Notice: Subject to any disclaimer, the term of this patent is extended or adjusted under 35 U.S.C. 154(b) by 4 days.

(21) Appl. No.: 11/102,316

(22) Filed: Apr. 8, 2005

(51) Int. Cl.
*A63B 21/08* (2006.01)
*A63B 23/14* (2006.01)
*A63B 23/16* (2006.01)

(52) U.S. Cl. ..... 482/97; 482/44; 482/49; 482/50

(58) Field of Classification Search ..... 482/79, 482/80, 97, 137, 44–46, 48–50
See application file for complete search history.

(56) References Cited

U.S. PATENT DOCUMENTS

| | | | | |
|---|---|---|---|---|
| 668,473 | A | 2/1901 | Yount | |
| 689,652 | A | 12/1901 | Perry | |
| 938,348 | A | 10/1909 | Stull | |
| 2,205,161 | A | 6/1940 | Vick | |
| 2,263,136 | A | 11/1941 | Johnson | |
| 2,814,491 | A | 11/1957 | Proctor | |
| 3,346,256 | A | 10/1967 | White | |
| 3,445,109 | A | 5/1969 | Kolbel | |
| 3,570,849 | A | 3/1971 | Ratchford | |
| 3,850,430 | A * | 11/1974 | Hamilton | 482/97 |
| 4,266,766 | A * | 5/1981 | Calderone | 482/97 |
| 4,616,825 | A | 10/1986 | Anderson | |
| 4,753,434 | A | 6/1988 | Salvino | |
| 4,783,067 | A | 11/1988 | Palmer | |
| 4,852,871 | A | 8/1989 | Perko | |
| 4,865,317 | A | 9/1989 | Hickey | |
| 4,923,195 | A * | 5/1990 | Calderone | 482/97 |
| 5,042,799 | A | 8/1991 | Stanley | |
| 5,046,725 | A * | 9/1991 | Brennan | 482/50 |
| 5,072,927 | A | 12/1991 | Santos | |
| 5,078,388 | A | 1/1992 | Dempsey, Jr. | |
| 5,125,878 | A | 6/1992 | Wingate et al. | |
| 5,141,478 | A | 8/1992 | Upper | |
| 5,222,926 | A | 6/1993 | Eggen | |
| 5,281,192 | A | 1/1994 | Nelson | |
| 5,336,140 | A | 8/1994 | LeBlond | |
| 5,472,400 | A | 12/1995 | Royer | |
| 5,496,240 | A | 3/1996 | Damm | |
| 5,556,359 | A | 9/1996 | Clementi | |
| 5,569,124 | A | 10/1996 | Raynie et al. | |
| 5,599,256 | A | 2/1997 | Hughes, Jr. | |
| 5,637,063 | A * | 6/1997 | Fuller, Sr. | 482/97 |
| 5,643,152 | A * | 7/1997 | Simonson | 482/100 |
| 5,720,699 | A | 2/1998 | Musachio et al. | |
| 5,769,757 | A | 6/1998 | Fulks | |
| 5,913,749 | A | 6/1999 | Harmon | |
| 5,957,813 | A | 9/1999 | Macdonald | |
| 5,964,685 | A | 10/1999 | Boland | |

(Continued)

*Primary Examiner*—Stephen R. Crow
(74) *Attorney, Agent, or Firm*—Harleston Law Firm; Kathleen M. Harleston

(57) ABSTRACT

A device for exercising hand and forearm muscles includes: (a) a substantially rectangular-shaped support frame; (b) a pivotable lever bar extending down at an angle from a first, inner corner of the frame, substantially bisecting the substantially rectangular-shaped frame when the device is not in use; (c) a pivot mechanism in the first corner of the frame for pivoting the lever bar, an upper end of the pivotable lever bar being affixed to the pivot mechanism; and (d) a weight support mechanism on the opposite, lower end portion of the lever bar for supporting at least one removable weight. Also included herein is a smaller, hand-held hand exercise device.

19 Claims, 8 Drawing Sheets

U.S. PATENT DOCUMENTS

| | | | |
|---|---|---|---|
| 6,036,621 | A | 3/2000 | Hancock |
| 6,056,678 | A | 5/2000 | Giannelli et al. |
| 6,099,438 | A | 8/2000 | Dawson |
| 6,406,406 | B1 | 6/2002 | Onorati |
| 6,416,447 | B1 | 7/2002 | Harmon |
| 6,491,608 | B1 | 12/2002 | Stearns |
| 6,565,485 | B1 | 5/2003 | Kinsella |
| 6,656,092 | B1 | 12/2003 | Fulks |
| 6,786,849 | B1 | 9/2004 | Faulconer |
| 2002/0013201 | A1 | 1/2002 | Loft et al. |
| 2002/0119871 | A1 | 8/2002 | Fulks |
| 2002/0137603 | A1 | 9/2002 | Vittone et al. |
| 2003/0114280 | A1 | 6/2003 | Rigas |
| 2005/0059531 | A1 | 3/2005 | Collier |

* cited by examiner

HAND EXERCISE DEVICE

CROSS REFERENCE TO RELATED DOCUMENT

This invention was described in Disclosure Document Number 551499, which was received by the U.S. Patent & Trademark Office on Apr. 19, 2004.

BACKGROUND OF THE INVENTION

1. Technical Field

The present invention relates to exercise devices for the hand and forearm.

2. Background Information

Many weightlifters who lift very heavy dead weight up over their heads find that they fail in the upper range of their weightlifting ability, not because they cannot support the weight, but because their grasp on the weight bar fails. Typically grip failure manifests itself on the lifts known as the "clean and jerk", which is lifting the weight to the chest, then jerking the weight up over the head while standing up, and the "dead lift", which is picking the weight up over the head with arms extended while standing in one smooth motion. Competitive weightlifters often train to strengthen their fingers so that they can maintain their grip while lifting very heavy weights. Various hand exercise devices, particularly devices having tension springs, are commercially available. However, there is currently no simple, inexpensive, easy to transport hand exercise device available that mimics a natural grip strength performance curve and that helps to progressively work hand, wrist, forearm muscles.

In addition to weightlifters, people requiring hand, wrist, or forearm muscle rehabilitation, such as those suffering from accidents, strokes, hand injuries, carpal tunnel release surgery, etc. may also utilize the hand exercise device of the present invention for physical therapy, with their physician's advice. With the present invention, weight can be added gradually to the exercise device over time at the user's discretion.

BRIEF SUMMARY OF THE INVENTION

The present invention is a device for exercising the hand and forearm. The device comprises:

(a) a substantially rectangular-shaped support frame;

(b) a pivotable lever bar extending down at an angle from a first, inner corner of the frame, substantially bisecting the frame when the device is not in use;

(c) a pivot mechanism in the first corner of the frame for pivoting the lever bar, an upper end of the pivotable lever bar being affixed to the pivot mechanism; and (d) a weight support mechanism on the opposite, lower end portion of the lever bar for supporting at least one removable weight. The exercise device preferably further includes a base plate attached to a bottom portion of the frame. Also included herein is a smaller, hand-held hand exercise device, and a magnetic version of the exercise device.

Advantages of the hand exercise device of the present invention include the following:

1) Useful for the rehabilitation of injured or weakened hands and/or fingers;

2) Great for use in strength development of the hand grip;

3) Angled resistance optimally exercises all fingers;

4) Provides a clear, concise, objective way to assess and develop hand strength;

5) Easily accommodates any size hand;

6) Provides full range variable resistance for achieving maximal strength development of hand grip;

7) Allows user to set the precise amount of resistance, and provides easily adjustable progressive resistance with removable weights of increasing weight;

8) Durable, reliable and accurate;

9) Measures gripping strength; and

10) Great for training for any sport or activity that requires hand gripping strength.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
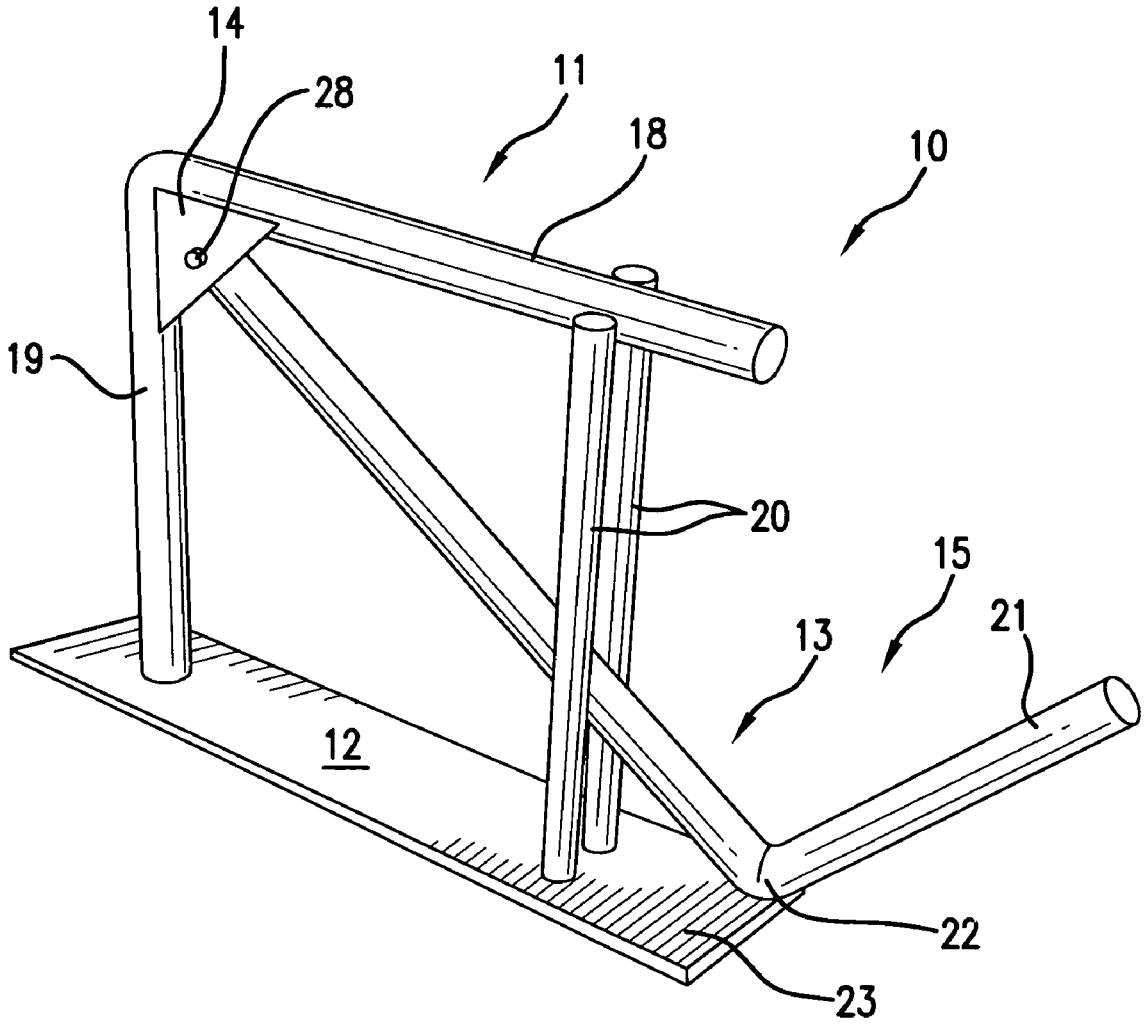
FIG. 1 is a perspective view of a hand exercise device according to the present invention.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Figure 2:
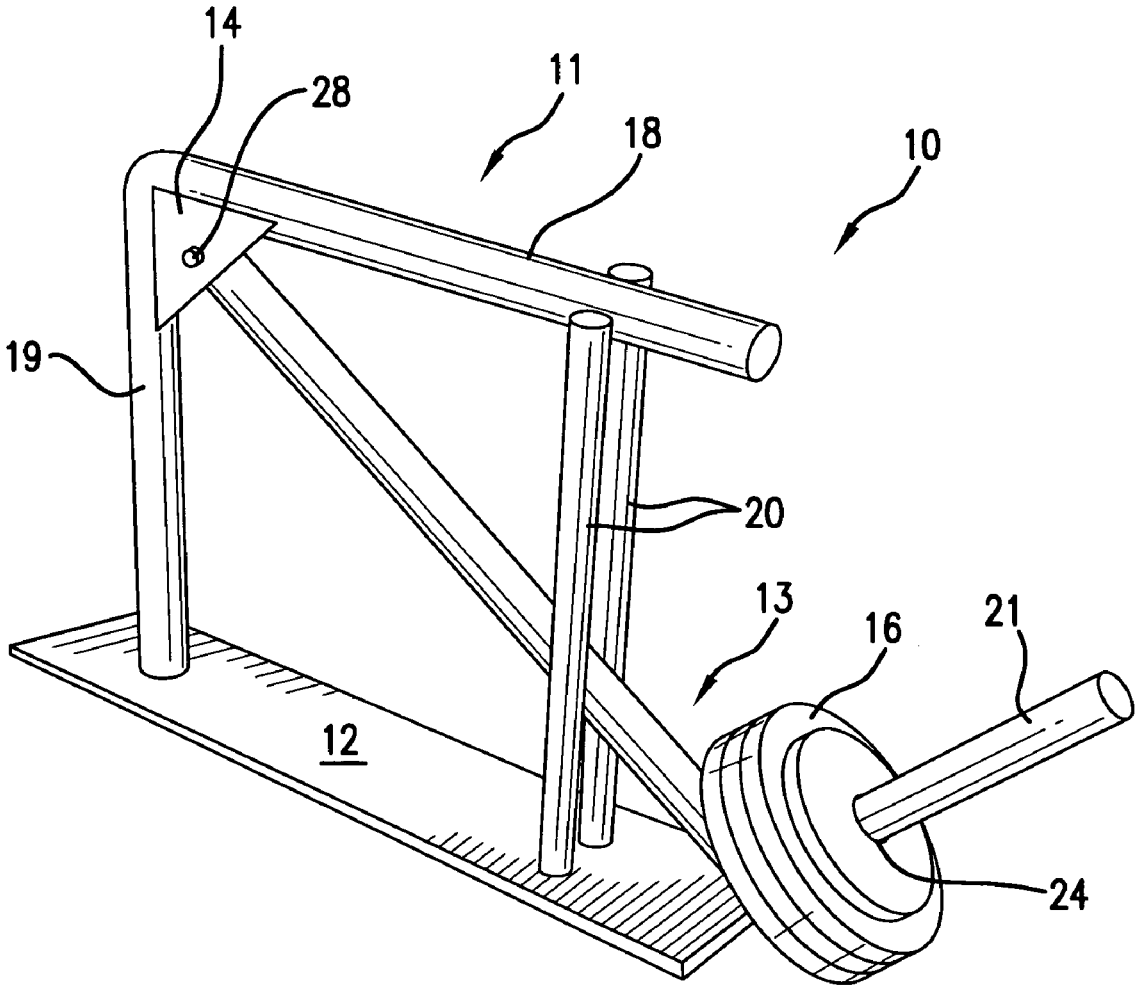
FIG. 2 is a front elevational view of a hand exercise device according to the present invention, shown with a weight.

Turning first to FIGS. 1 and 2, a portable hand exercise device 10 according to the present invention comprises: (a) a substantially rectangular-shaped support frame 11; (b) a pivotable lever bar 13 extending down at an angle from a first, inner corner of the frame; (c) a mechanism 14 in the first corner of the frame 11 for pivoting a first, upper end of the lever bar 13 from an upper corner of the frame 11; (d) a mechanism 15 on the lever bar 13 for supporting at least one removable weight 1; and preferably (e) a base plate 12 attached to a bottom portion of the frame 11. The upper end of the lever bar 13 is movably affixed to the pivoting mechanism 14, and an opposite, lower end 22 of the lever bar 13 rests on one side 23 of the base plate 12. The opposite end 22 of the lever bar 13 contacts the base plate 12, with the lever bar 13 at an approximately 45 degree angle with respect to the base plate, and to the substantially horizontally oriented upper handle support bar 18, when the exercise device 10 is not in use.

Continuing with FIGS. 1 and 2, the frame 11 of the exercise device is comprised of a substantially horizontally oriented upper handle support bar 18 connected at one end to a substantially vertically oriented side support bar 19. An opposite, lower end of the substantially vertical side support bar 19 is affixed to one side of the planar base plate 12. An opposite end portion of the upper handle support bar 18 is connected to, or rests between, two, matching, spaced apart, substantially vertically oriented side guide bars 20. A portion of the lever bar 13 passes between the two substantially vertical side guide bars 20. As shown in FIG. 2, the weight support mechanism 15 is outside the frame 11. The opposite, lower ends of the guide bars 20, which are preferably approximately the same length as the substantially vertical support bar 18, are also affixed to the base plate 12 on an opposite, second side 23 of the base plate 12.

As shown in FIGS. 1 and 2, the mechanism 15 for supporting the weights is an end leg 21 of the lever bar, which has been bent into an "L" shape. The other leg of the L-shaped bar is the lever portion. The apex 22, or crook, of the L-shaped bar (which is the end of the lever bar portion) contacts the second side 23 of the base plate when there are not weights on the weight support leg 21 and the hand exercise device 10 is not in use. The upwardly projecting end leg 21 at a 90 degree angle with respect to the lever bar portion keeps the weights 16 on the leg 21 during lifting. The support bars are preferably made of tubing, most preferably aluminum tubing. The substantially horizontally oriented upper handle support bar 18 and the substantially vertically oriented side support bar 19 may be formed from a single bar that has been bent at about a 90° angle.

Just prior to use, the user places one or more light weights 16 on to the weight support leg 21 of the lever bar 13. Each disk-shaped weight 16 comprises a central aperture 24 sized to closely accommodate the weight support leg 21 of the lever bar. The user slides the weight support bar leg 21 through the aperture 24 in the weight 16. A second weight can be stacked on top of the first weight, if desired. Any suitable removable weights can be used. After use, the weights are preferably removed from the weight support leg 21 and stored. The weights slip easily on and off the weight support leg 21. This weight-loaded exercise device 10 is for strengthening a user's hand grip and for building hand, wrist, and forearm muscles.

Figure 3:
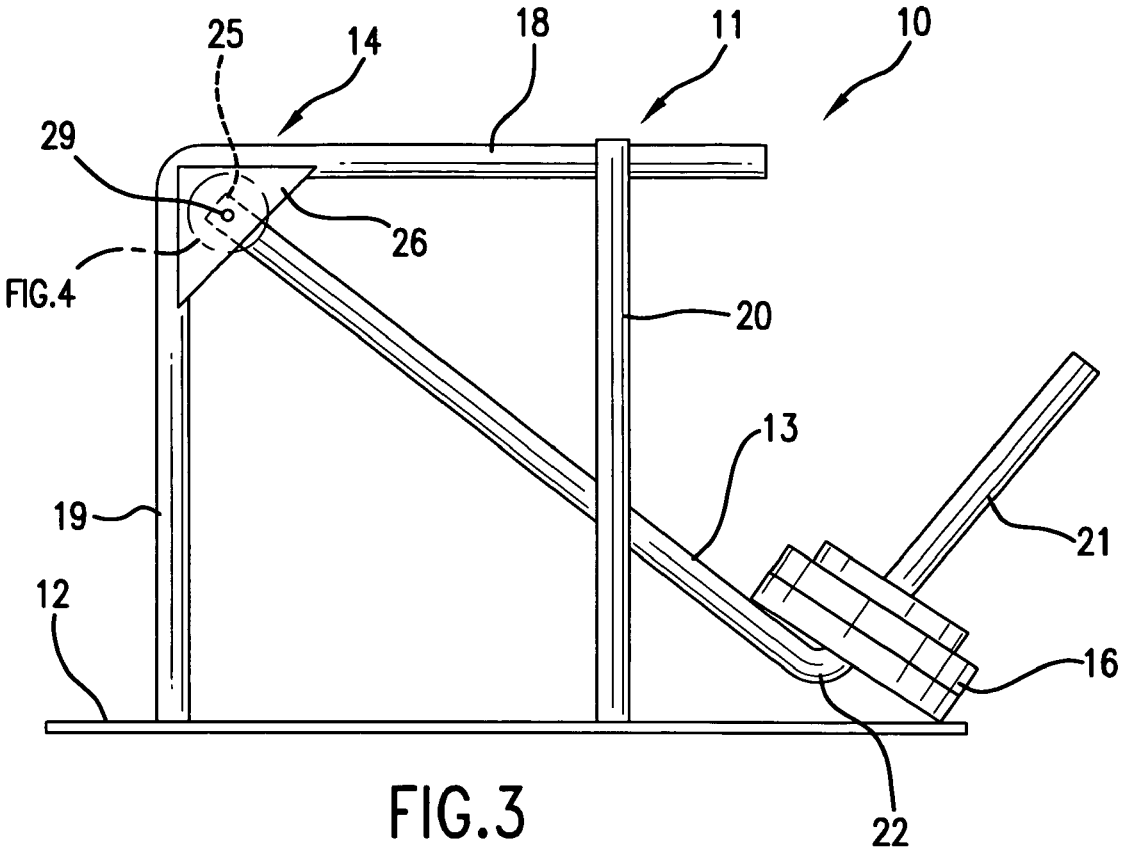
FIG. 3 is a side elevational view of the hand exercise device according to FIG. 2.
Figure 4:
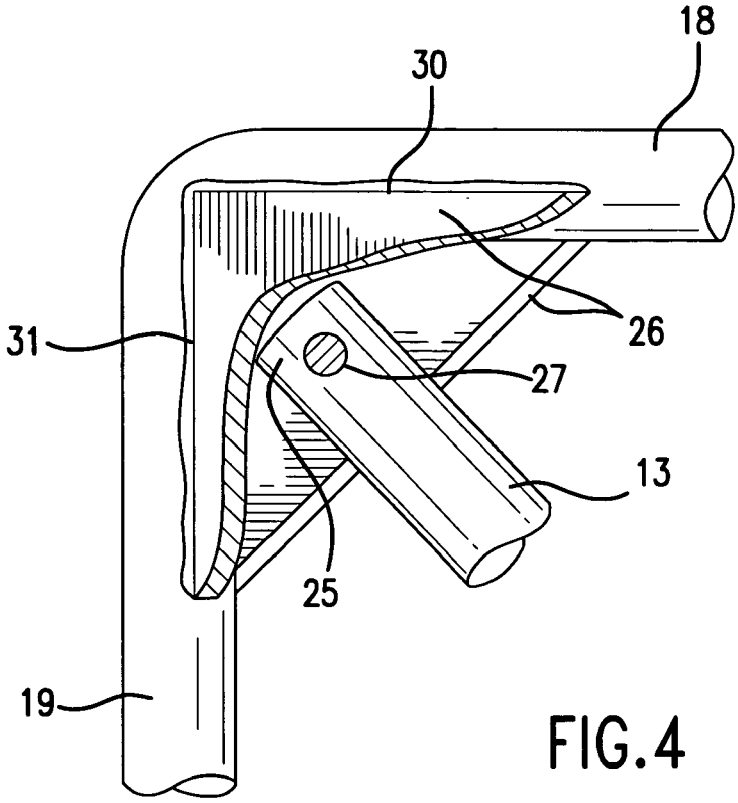
FIG. 4 is an expanded, cutaway view of the hand exercise device according to FIG. 3.

Referring to FIGS. 3 and 4, the pivoting mechanism 14 comprises: two matching, spaced apart, triangular shaped pivot plates 26, and a lever bar pin 28 that extends through the pivot plates 26, and through the upper end 25 of the lever bar 13. A top edge 30 of each pivot plate 26 is attached to the substantially horizontally oriented support bar 18, and an adjacent, side edge 31 of each pivot plate 26 is attached to the substantially vertically oriented side support bar 19. Each pivot plate 26 has a central pivot plate aperture 29 (see FIG. 4). The upper end 25 of the lever bar 13, which includes a hole 27, extends between the pivot plates 26. The lever bar pin 28 extends through the aperture 29 in one pivot plate 26, through the hole 27 in the upper end of the lever bar, and through the aperture 29 in the other pivot plate 26. The lever bar pin 28 is preferably flattened at its opposite ends so that it remains in place. The lever bar 13 pivots on the lever bar pin 28.

Other suitable pivoting mechanisms may be employed herein. For example, the pivot mechanism 14 may comprise a round roller bearing assembly, a machined pin, and a plurality of stainless steel rollers or ball bearings. The rollers are lined up in a channel around the periphery of the roller bearing assembly. The lever bar 13 is inserted through a central hole in the roller bearing assembly. The machined pin holds the roller bearing assembly on the lever bar. This variation is believed to reduce the frictional coefficient of the lever bar 13 moving up and down. A bearing assembly could alternatively be utilized on the side guide bars 20 to reduce friction from the lever bar movement.

Figure 5:
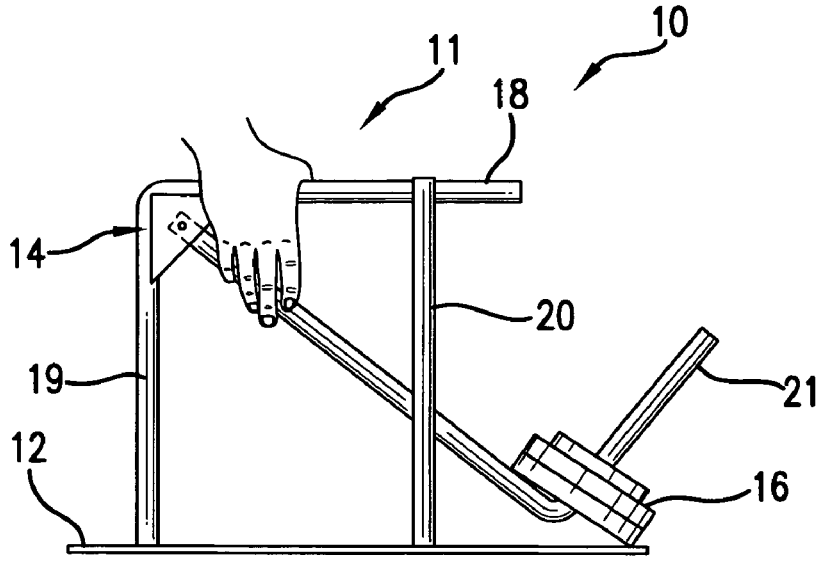
FIGS. 5–7 are side elevational views of the hand exercise device according to FIG. 3, shown in use.
Figure 6:
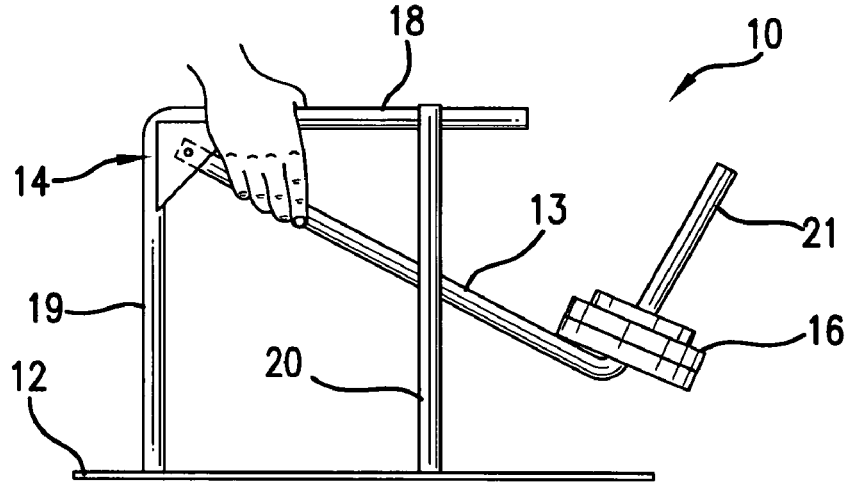
Figure 7:
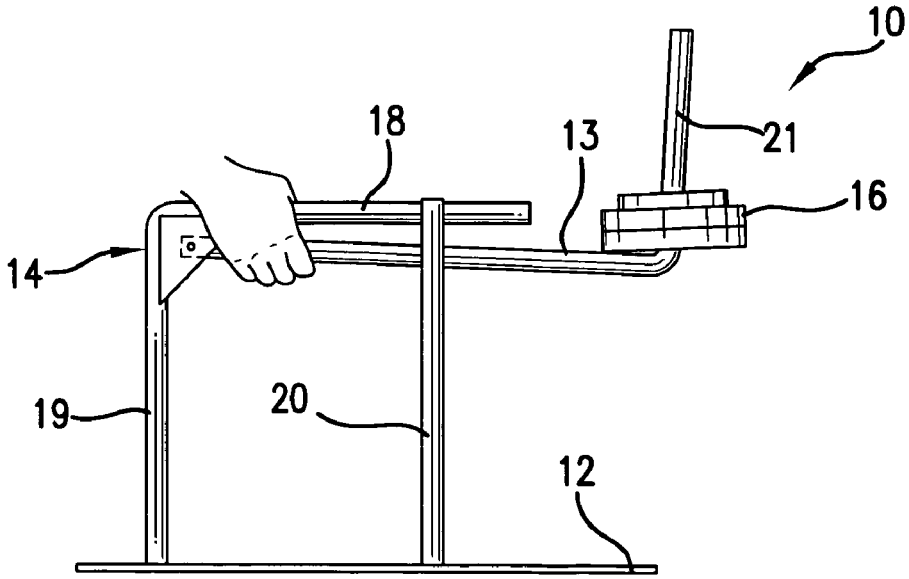

Turning now to FIGS. 5 through 7, the user begins by draping the hand over the upper handle support bar 18 with the palm on top of the upper handle support bar 18 and the hand in a relaxed position (see FIG. 5). One or two relatively light weights 16 have been placed on the weight support leg 21. The present exercise device 10 may be used with the right hand, as depicted, or the left hand. The user grasps the lever bar 13 with his or her fingers and slowly lifts the lever bar 13, as shown in FIG. 6. The lever bar pivots up on the lever bar pin 28 toward the upper handle support bar 18. The user continues to tighten his or her grasp until the lever bar 13 is nearly parallel to the upper handle support bar 18, as shown in FIG. 7. After holding for a few seconds in the closed position (FIG. 7), the user preferably slowly returns the lever bar 13 to the resting position shown in FIG. 5.

Without meaning to be bound by theory, it is believed that the hand exercise device of the present invention is so effective because it follows the natural performance of the hand when it grips an item. The lever bar 13 of the device is positioned at about a 45 degree angle relative to the base plate 12 (or base support bar 35) so that it corresponds to the strength performance curve of a hand grip. A healthy person's grip is weakest when the hand is in the fully extended position as shown in FIG. 5, stronger in the partially closed position shown in FIG. 6, and strongest in the fully closed position shown in FIG. 7. Similarly, the lever bar 13 is easiest to lift when it is near the 45 degree incline shown in FIG. 5. The closer the lever bar 13 gets to the upper support bar 18, the tougher it is to lift it. This corresponds to the natural grip, supplying more resistance when it is needed. Importantly, too, the present exercise device 10 allows weights 16 to gradually be mounted on the device 10 at the user's sole discretion. This makes the exercise device 10 as useful to a weightlifter as it is to an elderly, home bound person with a weak grip.

A user normally begins exercising with a lighter weight, and gradually increases the total weight he or she lifts each week to a maximum weight that is comfortable. For example, an inexperienced user might begin by lifting a one pound weight for about 15 minutes each day for a week, then increase the weight by ½ pound each week up to a five pound maximum. The lifting regimen can be customized for different users. For example, a user might choose to lift more weight initially with his right hand than his left hand, then gradually increase the weight that his left hand is lifting until the strength in his left hand catches up to the strength in his right hand, or he might exercise only with his left hand until its lifting capacity catches up to his right hand. A user who has had right hand or wrist surgery might exercise only that hand, beginning carefully with a very low amount of weight and only a few repetitions.

The hand exercise device 10 allows adjustment of the amount of weight loaded on its weight support leg, so the same exercise device 10 can be used by different people in a household or gym, for example, with widely varying needs and fitness levels. For example, a weightlifter son in a family owning a hand exercise device 10 might load heavier weights (e.g., five pounds) on the weight support leg for his daily workout, while the weightlifter's mother with a previous hand injury and a doctor's instructions for its care might load a light weight (e.g., ½ pound) and lift the lever bar a prescribed number of repetitions for her biweekly workout. Regular use of the hand exercise device 10 over time is believed to increase grip strength and hand fitness.

The user may be standing, sitting (e.g., on an exercise bench), or in any appropriate position during use of the exercise device 10. To use it, the exercise device 10 is placed upright, as shown in FIGS. 1 and 2, with the base plate 12 on the floor or ground. The exercise device 10 is lightweight and easy to transport, but the base plate can be bolted to a gym floor if desired. The weights 16 are then added onto the upwardly projecting weight support leg 21 one at a time until the user reaches the desired weight. The hand exercise device 10 preferably supports about 50 to 100 pounds of weight. After exercise, the weight-less hand exercise device 10 is easy to store (e.g., on its side under a bed or upright and propped against a closet wall).

Figure 8:
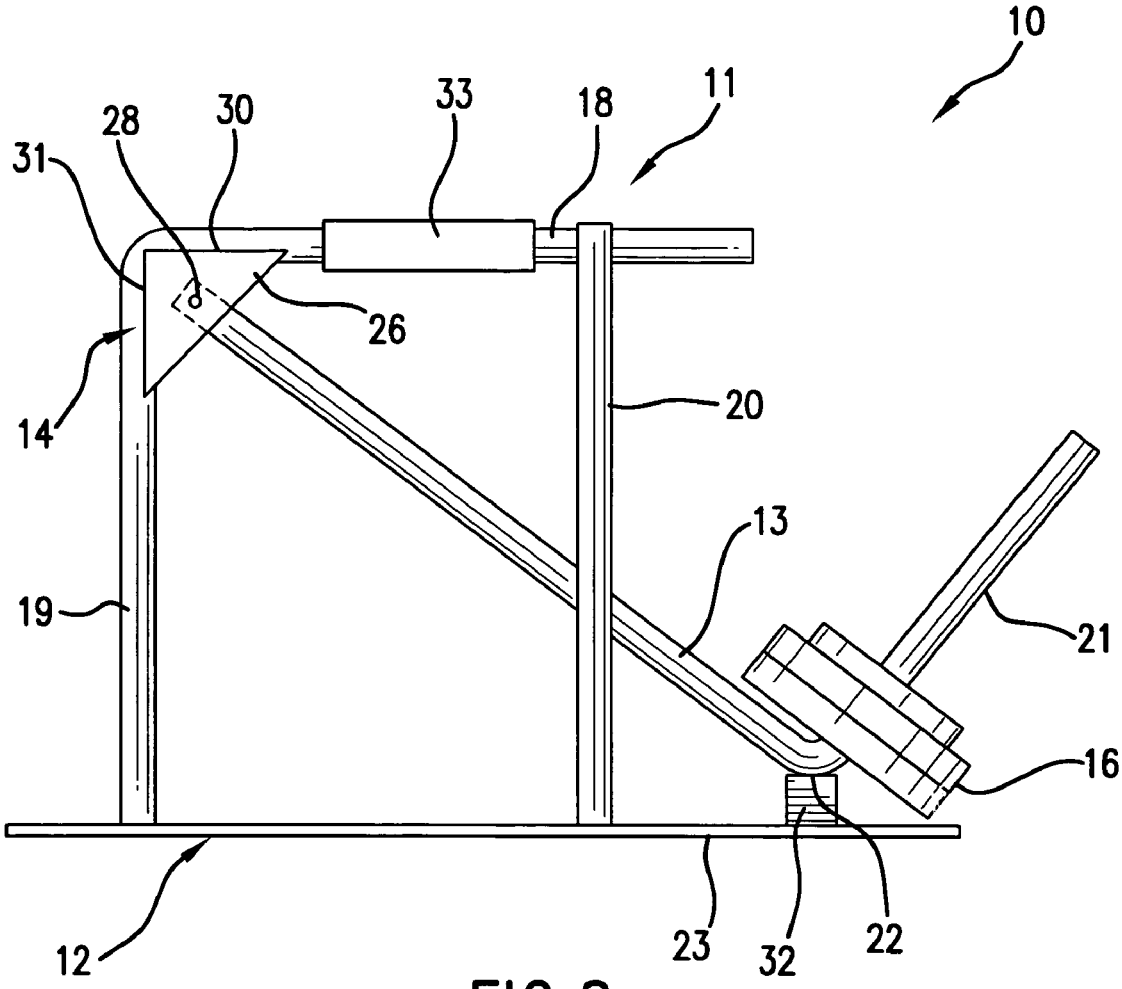
FIG. 8 is a side elevational view of a hand exercise device according to the present invention, shown with a bumper.

Referring to FIG. 8, a bumper 32 is attached to the side 23 of the base plate 12 to cushion the end 22 (or apex of an L-shaped bar) of the lever bar 13 when the user drops it while exercising. The bumper 32 is positioned under the lower end 22, or apex, of the lever bar 13 when the exercise device 10 is not in use. The bumper 32 is preferably made of a hard plastic or rubber-like material. In addition to protecting the exercise device 10 from damage, the bumper 32 also dampens the sound of the weights 16 clanging together when the lever bar 13 is dropped.

The exercise device 10 optionally includes a hand gripping surface material 33 on the upper support bar 18, as shown in FIG. 8, to help prevent a user's sweaty hand from slipping during the hand exercise. The upper support bar hand grip 33 is preferably made of a thin, cushioned gripping material wrapped around and adhered to the central portion of the upper support bar 18.

Figure 9:
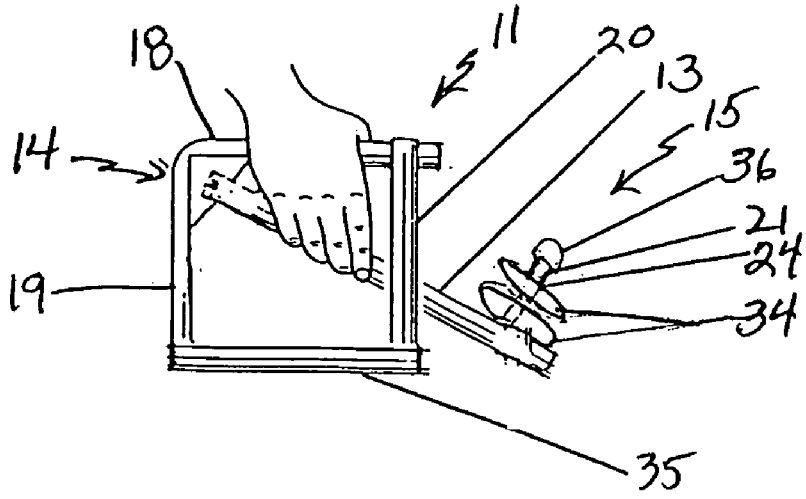
FIG. 9 is a side elevational view of a hand-held hand exercise device according to the present invention.

Turning to FIG. 9, a hand-held hand exercise device according to the present invention is small and compact, easy to transport, and is easy to use anywhere. For example, it can be carried to work in a handbag or briefcase and then taken out for use in exercising one hand while the other hand is otherwise engaged. It can be used by a user with any size hands, from very small to very large. The hand-held device can be used without resting the base support bar on a flat surface.

The removable weights 34 for the hand-held device are small and have rounded edges for safety. They are preferably egg-shaped or doughnut-shaped, and have a central aperture through which the weight support leg 21 of the lever bar extends when they are in use. Alternatively, each hand-held device weight is substantially flexible and C-shaped, so it can quickly be clipped onto, or unclipped from, the weight support leg 21 in one motion.

A removable end cap 36 fitted to the end of the weight support leg 21 helps to prevent the weights from coming off the leg 21. A locking pin (not shown) inserted in a hole at the end of the weight support leg 21 may be used instead of an end cap. Here, the weight support leg 21 projects in a generally upward direction from an end portion of the lever bar 13 (at about a 90 degree angle). If desired, the weight support leg 21 may itself be weighted to provide a small amount of weight with which to begin training.

As shown in FIG. 9, the rectangular-shaped (most preferably square-shaped) frame 11 of the hand-held exercise device 10 is just large enough for a person's hand (large size) to extend thorough. At the bottom of the hand-held exercise device 10 is a base support bar 35, the bottom of which is flat, if desired, so that the exercise device 10 can be positioned upright and remain upright on a planar surface, such as a table. Otherwise, the exercise device 10 can be laid on its side when it is not in use. Each support bar 18, 19, 20, 35 is most preferably between about six and about ten inches in length. The support bars 18, 19, 20, 35 of the frame 11 are preferably the same length and width. The upper support bar 18 is in spaced parallel relation to the base support bar 35.

Figure 10:
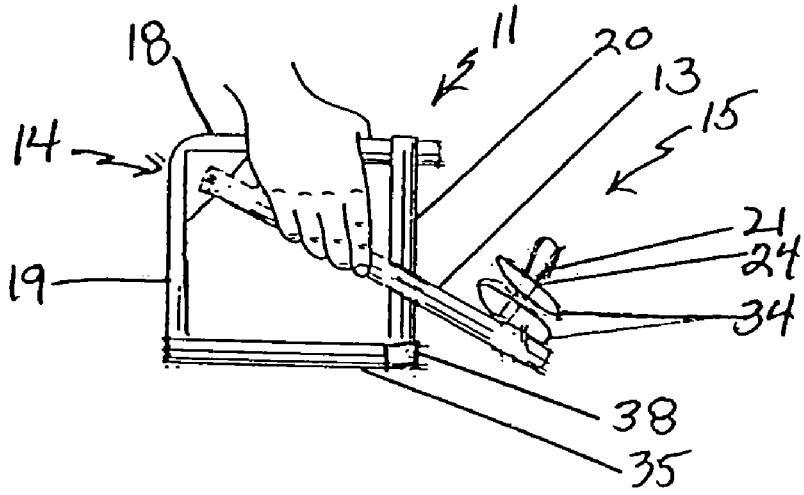
FIG. 10 is a side elevational view of a hand-held hand exercise device according to the present invention, shown with one side guide bar.

The hand-held exercise device 10 includes either two matching, spaced apart guide bars 20 with the lever bar 13 extending between the two guide bars 20, as depicted in FIG. 9, or a single guide bar 20 to the side (right or left) of the lever bar 13, as shown in FIG. 10. In the latter case (seen in FIG. 10), the hand-held exercise device 10 includes a square or rounded lever bar stop 38 projecting from an end of the base support bar 35 away from the guide bar 20. The stop 38 prevents the lower end portion of the lever bar 13 from swinging down (into a vertical position). In the later case (single guide bar), the user's hand guides the lever bar against the guide bar 20.

Continuing with FIG. 10, the weight 34 of the hand-held exercise device is magnetic, so that it adheres to a magnet-attractive receiving leg 21. The magnetic weights are very easy to add or take away. The mechanism 14 for pivoting the lever bar is as described hereinabove, except that it is on a smaller scale.

Figure 11:
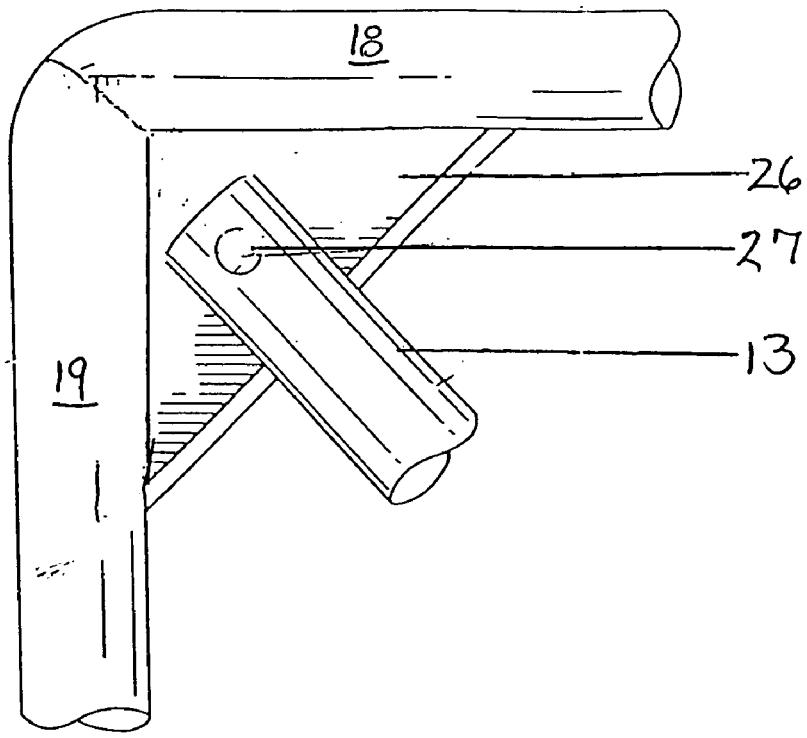
FIG. 11 is an expanded, perspective view of a corner of a hand exercise device according to the present invention.
Figure 12:
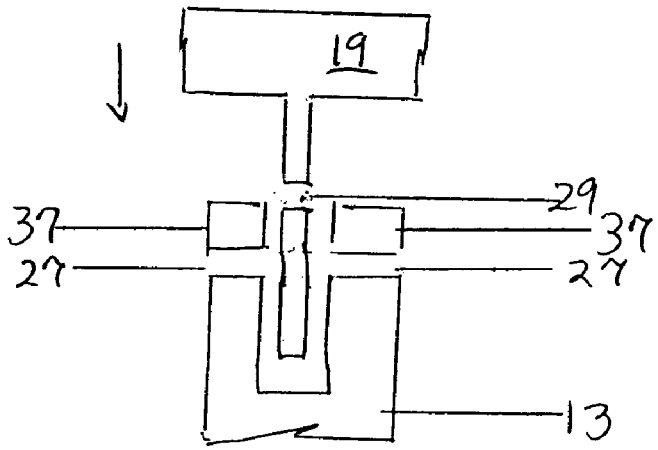
FIG. 12 is a top plan view of a pivoting mechanism of a hand exercise device according to the present invention.

Referring to FIGS. 11 and 12, in the pivot mechanism 14, the end portion 25 of the lever bar 13 in either hand exercise device 10 is split into two matching sections 37, and a portion of a single pivot plate 26 extends between the two split sections 37 of the lever bar end. The pivot mechanism 14 comprises the pivot plate 26, which is attached to an upper corner of the frame 11. The pivot plate 26 is fastened to the juncture between the upper support bar 18 of the frame, and the side support bar 19 of the frame, as seen in FIG. 11. As shown in FIG. 12, the lever bar pin 28 extends through a lever bar hole 27 in one split section 37, through the pivot plate aperture 29 in the pivot plate 26, and through the corresponding lever bar hole 27 in the other split section 37.

Figure 13:
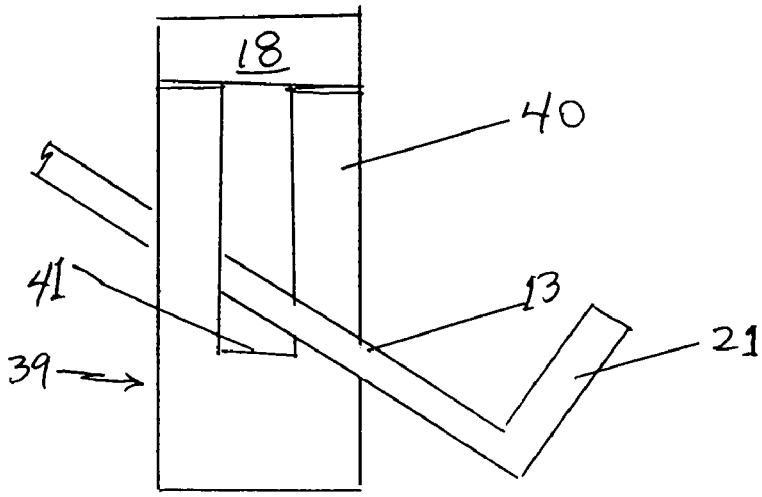
FIG. 13 is a front perspective view of a hand exercise device according to the present invention.

Referring to FIG. 13, an alternative to the dual guide bars 20 depicted in FIGS. 1 thorough 3 is a split guide bar 39. The split guide bar 39 comprises two matching, spaced apart guide bar arches 40 with a guide bar bridge 41 between them. The lever bar 13 extends through the split guide bar arches 40, and a portion of the lever bar rests on the guide bar bridge 41 when the exercise device is not in use. This guide bar bridge 41 prevents the lever arm 13 from swinging down too far, and mutes the sound of weights clanging and potential damage when the weight loaded lever bar is dropped. The guide bar arches 40 guide the lever bar when the device 10 is in use.

Figure 14:
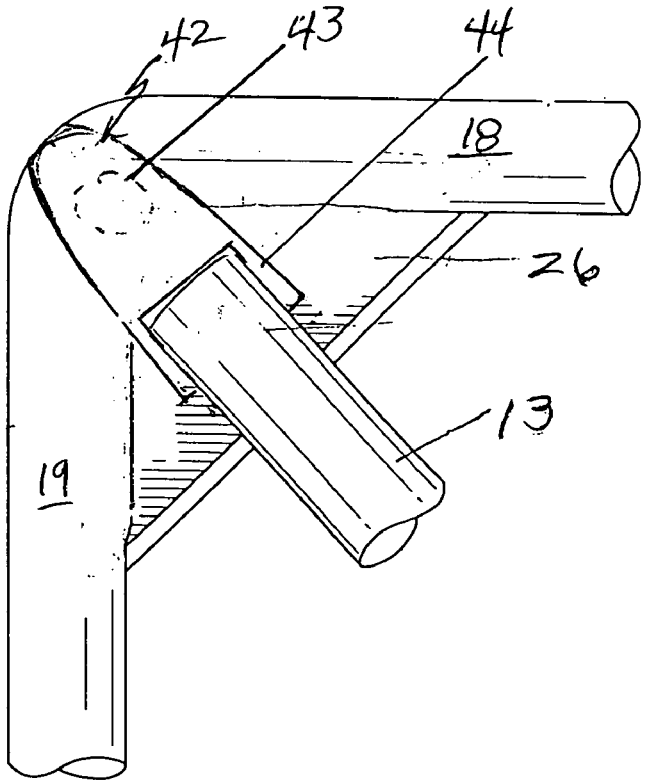
FIG. 14 is an expanded, perspective view of a corner of a hand exercise device according to the present invention.

Referring to FIG. 14, an alternative pivot mechanism includes a lever bar coupling 42 with a rounded end that is pivotably pinned between the pivot plates 26 in the corner between the upper and side support bars 18, 19. A lever bar pin 28 is inserted through the holes in the pivot plates 26 and through a hole 43 in the rounded end portion of the lever bar coupling 42. The upper end portion 25 of the lever bar 13 is fastened to a female portion 44 of the lever bar coupling 42 opposite its rounded end portion (e.g., by epoxy or welding). The pivot plates 26 are welded in place on either side of the lever bar coupling 42. There may be one or two pivot plates 26. The lever bar 13 is pivotable.

The hand exercise device 10 herein preferably does not include springs or rubber/elastomeric bands or cords to supply tension.

From the foregoing it can be realized that the described device of the present invention may be easily and conveniently utilized as a hand exercise device. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 hand exercise device
11 frame
12 base plate
13 lever bar
14 pivoting mechanism
15 weight support mechanism
16 weights
18 upper support bar
19 side support bar
20 guide bars
21 weight support leg
22 apex of lever bar
23 apex side of base plate
24 aperture in weight
25 upper end of lever bar
26 pivot plates
27 hole in lever bar
28 lever bar pin
29 aperture in pivot plate
30 top edge of pivot plate
31 side edge of pivot plate
32 bumper
33 upper support bar grip
34 egg-shaped weights
35 base support bar
36 weight end cap
37 split sections of lever bar end
38 lever bar stop
39 split guide bar
40 arches of split guide bar
41 bridge of split guide bar
42 lever bar coupling
43 hole in coupling
44 female portion of coupling

What is claimed is:

1. A hand exercise device, comprising: (a) a substantially rectangular-shaped support frame; (b) a pivotable lever bar extending down at an angle from a first, inner corner or the frame, substantially bisecting the substantially rectangular-shaped frame when the device is not in use; (c) a pivot mechanism in the first corner of the frame for pivoting the lever bar, an upper end of the pivotable lever bar being affixed to the pivot mechanism; (d) a weight support mechanism on the opposite, lower end portion of the lever bar for supporting at least one removable weight; and (e) a substantially horizontally oriented upper handle support bar connected at one end to two substantially vertically oriented, matching, spaced apart side guide bars; wherein a portion of the lever bar extends between the two side guide bars; whereby a user rests a palm of one hand on the horizontally oriented upper handle support bar and grasps the pivotable lever bar with the fingers of the one hand and pulls the pivotable lever bar upwards.

2. The exercise device according to claim 1, wherein a bottom portion of the frame is attached to a base plate, and the lower end of the lever bar contacts the base plate, with the lever bar at an approximately 45 degree angle with respect to the base plate when the device is not in use.

3. The exercise device according to claim 1, wherein the frame further comprises a substantially vertically oriented side support bar connected at an upper end to an end of the substantially horizontally oriented upper handle support bar, the substantially horizontally oriented upper handle support bar being connected at an opposite end to ends of the two substantially vertically oriented, matching, spaced apart side guide bars; and wherein the weight support mechanism is outside the frame.

4. The exercise device according to claim 1, wherein the lever bar is substantially L-shaped, and the weight support mechanism is an end leg of the L-shaped lever bar.

5. The exercise device according to claim 4, wherein an apex of the substantially L-shaped bar contacts a side portion of the base plate when the hand exercise device does not hold weights.

6. The exercise device according to claim 1, wherein the pivot mechanism comprises two matching, spaced apart, triangular shaped pivot plates attached to the first corner of the frame, and a lever bar pin that extends through corresponding central apertures in the pivot plates, and through a hole in the upper end of the lever bar.

7. The exercise device according to claim 6, wherein the lever bar pin extends through the aperture in one pivot plate, through the hole in the upper end of the lever bar, and through the aperture in the other pivot plate.

8. The exercise device according to claim 1, further comprising a bumper attached to the base plate.

9. The exercise device according to claim 1, wherein the opposite ends of the substantially vertically oriented side support bar and the side guide bars are attached to a base plate.

10. The exercise device according to claim 1, wherein the frame comprises a substantially horizontally oriented upper support bar connected at one end to a substantially vertically oriented side support bar, and at an opposite end to a substantially vertically oriented, split side guide bar, the split guide bar comprising two matching, spaced apart guide bar arches with a guide bar bridge between them; wherein a portion of the lever bar extends between the two guide bar arches and rests on the guide bar bridge when the device is not in use.

11. The exercise device according to claim 1, wherein the device does not comprise any springs.

12. A hand-held hand exercise device, comprising:

(a) a substantially rectangular-shaped support frame, comprising a substantially horizontally oriented upper handle support bar, a substantially vertically oriented side support bar connected to an end of the upper handle support bar, a substantially horizontally oriented base support bar connected to an opposite, lower end of the side support bar, and at least one substantially vertically oriented side guide bar connected at its lower end to the base support bar;

(b) a lever bar extending down at an angle from a first, inner corner of the frame;

(c) a pivot mechanism in the first corner of the frame for pivoting the lever bar, an upper end of the lever bar being affixed to the pivot mechanism; and (d) a weight support mechanism on a lower end portion of the lever bar for supporting at least one removable weight;

whereby a user rests a palm of one hand on the horizontally oriented upper handle support bar and grasps the pivotable lever bar the fingers of the one hand and pulls the pivotable lever bar upwards.

13. The hand-held exercise device according to claim 12, wherein the base support leg further comprises a lever bar stop.

14. The hand-held exercise device according to claim 12, wherein the weight support mechanism is a weight support leg extending in a generally upward direction from the lower end portion of the lever bar.

15. The hand-held exercise device according to claim 14, wherein the weight support leg is magnet-attractive and the weight is magnetic.

16. The hand-held exercise device according to claim 14, wherein the weight is substantially C-shaped for attachment to the weight support leg, the weight support leg being at about a right angle to the lever bar.

17. The hand-held exercise device according to claim 12, wherein the pivot mechanism comprises a pivot plate attached to the first corner of the frame; wherein the upper end portion of the lever bar is split into two matching split sections, a portion of the pivot plate extending between the two split sections of the lever bar end.

18. The hand-held exercise device according to claim 17, wherein the lever bar pin extends through a hole in one split section, through the aperture in the pivot plate, and through a corresponding hole in the other split section of the lever bar end portion.

19. The hand-held exercise device according to claim 12, wherein the pivot mechanism comprises at least one pivot plate attached to the first corner of the frame, a lever bar coupling with a rounded end portion, the lever bar coupling being pivotably pinned to the at least one pivot plate; the upper end portion of the lever bar being attached to a female portion of the lever bar coupling, the female portion being opposite to the rounded end portion of the lever bar coupling.

* * * * *